US005491986A

United States Patent [19]

White

[11] Patent Number: 5,491,986

[45] Date of Patent: Feb. 20, 1996

[54] INTERCHANGEABLE MULTIPLE MOUNT HEAD SYSTEM FOR JEWELRY

[75] Inventor: Howard White, Staten Island, N.Y.

[73] Assignee: Omega Casting Corp., New York, N.Y.

[21] Appl. No.: 194,102

[22] Filed: Feb. 8, 1994

Related U.S. Application Data

[63] Continuation-in-part of Ser. No. 81,019, Jun. 22, 1993, Pat. No. 5,440,900.

[51] Int. Cl.[6] ..... A44C 17/02

[52] U.S. Cl. ..... 63/29.1; 24/115 G

[58] Field of Search ..... 63/29.1, 2, 15; 24/115 G, 115 H, 265 AL, 265 WS

[56] References Cited

U.S. PATENT DOCUMENTS

| | | | |
|---|---|---|---|
| 996,678 | 7/1911 | Reynolds | 63/29.1 |
| 1,069,254 | 8/1913 | Henning | 63/29.1 |
| 1,412,810 | 4/1922 | Rosenthal | 63/29.1 |
| 1,529,257 | 3/1925 | Lampl . | |
| 1,578,940 | 3/1926 | Wacha . | |
| 2,058,358 | 10/1936 | Schmidt | 63/29.1 |
| 2,571,674 | 10/1951 | Braunstein | 63/15 |
| 2,586,758 | 2/1952 | Zerr . | |
| 2,595,462 | 5/1952 | Johnson . | |
| 2,615,313 | 10/1952 | Schaeffer | 63/15 |
| 2,637,884 | 12/1953 | Morehouse . | |
| 2,668,605 | 2/1954 | Schaeffer | 63/15 |
| 2,830,347 | 4/1958 | Waller . | |
| 3,168,768 | 2/1965 | Bohlinger et al. . | |
| 3,192,737 | 7/1965 | Schechter et al. | 63/15 |
| 3,347,037 | 10/1967 | Klang . | |
| 3,974,545 | 8/1976 | Lossini . | |
| 4,530,221 | 7/1985 | Weinberg | 63/2 |
| 4,542,630 | 9/1985 | Nanasi et al. . | |
| 4,611,368 | 9/1986 | Battersby . | |
| 4,628,708 | 12/1986 | Ivey . | |
| 4,754,534 | 7/1988 | Helwick . | |
| 4,878,269 | 11/1989 | Anscher et al. | 24/115 G |
| 4,912,814 | 4/1990 | McKenzie . | |
| 5,214,940 | 6/1993 | Capifali . | |
| 5,351,505 | 10/1994 | Febrer | 63/2 |

FOREIGN PATENT DOCUMENTS

| | | | |
|---|---|---|---|
| 783269 | 7/1935 | France | 63/29.1 |

*Primary Examiner*—Michael J. Milano

*Attorney, Agent, or Firm*—Levisohn, Lerner, Berger & Langsam

[57] ABSTRACT

A jewelry item having an interchangeable head capable of being attached to different jewelry items, such as a ring, bracelet or necklace.

18 Claims, 3 Drawing Sheets

INTERCHANGEABLE MULTIPLE MOUNT HEAD SYSTEM FOR JEWELRY

CROSS-REFERENCE TO RELATED APPLICATIONS

This application is a continuation-in-part of U.S. application Ser. No. 08/081,019 filed Jun 22, 1993 now U.S. Pat. No. 5,440,900.

BACKGROUND OF THE INVENTION

1. Field of the Invention

This invention pertains to decoration for jewelry, more particularly to a decorative head which is interchangeably mounted on an item of jewelry that is worn around a body portion, such as a ring, a bracelet, a necklace and other jewelry items that feature a general loop design.

2. Description of the Prior Art

Bracelet assemblies may be found which have removable heads. In one design, which is the subject of my co-pending application Ser. No. 08/081,019 filed Jun 22, 1993, of which this is a continuation-in-part, the head is disk shaped with a downward extending peripheral wall. The circular, downward extending wall of the head has narrow, vertical slob which open to the bottom of the circular wall, for receiving heavy metal strands which comprise the strap loop of the bracelet. The strands, which cross the bottom of the head, are pressed upward into the grooves by a retainer ring that is pressed upward from below the strands, into the shell of the head, until the retainer ring passes an interference fit with a reduced diameter of the lower margin of the circular wall. This arrangement provides orientation of the design in a predetermined position with respect to the strap.

U.S. Pat. No. 2,586,758 to Zerr discloses a jewelry chain connector which allows for a decorative top 28 on cover 22. The jewelry chain connector comprises a plurality of notch openings or slots 15 through which connecting members 16 between facet retainers 17 of a chain are located. The slots 15 in conjunction with side walls 13 and 14 hold the chain between facets 17 and 18 in the area of connecting member 16. The only location available to connect the chain to the buckle or lock with cover 22 is in the connecting member regions 16 of the chain. Further, the Zerr jewelry chain connector fails to show interchangeability between a chain and ring, and the cover 22 does not have depending side walls which are adapted to cooperate with either the bar of a ring or the chain of a bracelet or necklace that hold the same in place with a transversely extending retainer member frictionally bearing on the bar or chain.

U.S. Pat. No. 4,530,221 to Weinberg also discloses an attachment for use with different necklaces in which there is a top or lip portion 104 which closes onto the chain 22. There is no suggestion for interchangeability between the attachment of Weinberg as between chains and rings, nor is there any suggestion of a retainer means to frictionally bear upon a chain or bar holding the same in place as set forth in the pending claims in this application.

U.S. Pat. No. 3,974,545 to Lossini is also directed to a slide locking assembly in which a member is adapted to hold a chain in place. A spring 40 bears against the chain 18 within slide locking assembly 10. Here again, there is no suggestion for interchangeability between a ring and necklace or bracelet, and there further fails to be shown, disclosed or suggested a retaining member in combination therewith slidable into and bearing upon the chain or bar means to hold the same in place. Further, recitation of first, second and third wall member is as set forth in claim 1 is neither found nor suggested in the prior art.

U.S. Pat. No. 3,347,037 to Klang discloses a spring 34 holding a chain in place similar to that described above with the Lossini patent 3,974,545. As such, the structure of the Klang patent does not show, disclose or suggest the applicant's invention as set forth in the pending claims.

U.S. Pat. No. 2,830,347 to Waller is to a chain slide having a spring 17 and serrated members 12, with a chain passing below the spring held in the serrated members. Here again, there is no suggestion for interchangeability between different jewelry items, nor is there an upper wall and depending first, second and third walls with a decorative head combination. Thus, the pending claims are patentable over the Waller reference.

SUMMARY OF THE INVENTION

It is one object of the invention to provide a system for interchangeably mounting the same design head on any one of a ring, bracelet, necklace or similar item of jewelry.

It is another object of the invention to provide in the above system an adaptation in each of the ring, bracelet, necklace or similar item of jewelry of the system, for receiving the design head, and affixing the design head on the item.

Other objects and advantages of the invention will become apparent to persons skilled in the art from the ensuing description.

In a system according to the present invention, a decorative head has first and second opposite side walls that are open to the bottom of the head for receiving bar or chain means through the walls. The bar or chain means form securement means of the top portion of the jewelry which wraps around a body part such as a finger, wrist or neck. As a point of distinction, the securement means of this invention may interchangeably be a fixed bar or a flexible chain.

The system further includes guide means on the head for receiving the bar or chain means for limiting lateral displacement between the head and the bar means with respect to the direction of the bar means through the first wall.

A third side wall, that is, between the first wall and a second side wall includes an opening for receiving retainer means into the head through the third wall transversely to the bar or chain means and below the bar or chain means when the bar or chain means is received in the first wall and the guide means.

Further in the system, an item of jewelry includes loop means in the form of a chain for circling a portion of a person's body for attachment of the item of jewelry to the person. The item of jewelry further includes such bar or chain means including the loop means and adapted for the receiving of the chain means in the guide means.

The head includes means for supporting the retainer means below the bar or chain means when the bar or chain means is received in the guide means and the retainer means is received through the third wall transversely to the bar or chain means. The guide means further limits rotational displacement between the head and the bar or chain means in a direction around the bar means.

The bar means version preferably comprises two bars that are close to one another and extend generally in the same direction where the bar means is received through the first wall. The two bars may also be rigidly positioned with respect to one another.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
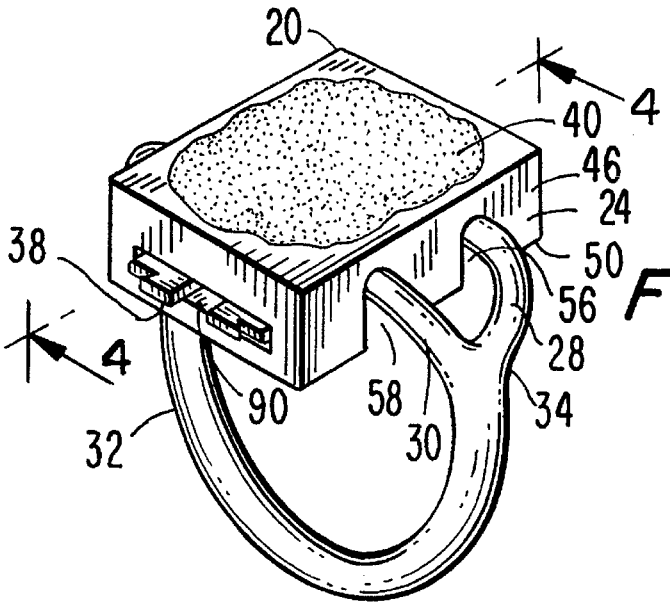
FIG. 1 is a perspective view of a jewelry system according to the present invention, showing the head mounted to a ring.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1, 2, 3, and 4, jewelry system 20 includes decorative head 24 which mounts on bars 28 and 30 of item of jewelry 32 which may be scaled in size to adorn a finger. Head 24 is retained on ring shank 34, by retainer slide 38.

Head 24 carries a jewelry design stone or combination thereof 40. When head 24 is assembled on ring shank 34, the design is normal to the appendage circled by shank or loop 42.

Side wall 46 is open to bottom 50 of the head for receiving bars 28 and 30 trough the wall into the head. Sides 52 and 54 of arched apertures 56 and 58 limit lateral displacement between the head and the bar so that design 40 is normal to the appendage.

Spaced apart apertures 56 and 58 which are formed in wall 46 have corresponding apertures 56' and 58' formed in opposite side wall 142 to receive and locate the two parallel bars 28 and 30.

Bars 28 and 30, being next to one another present a generally oblong or irregular profile element 60 in cross section which, in cooperation with upper edge 62 of apertures 56 and 58 and retainer slide 38, limits rotational displacement between head 24 and oblong element 60 in a direction around element 60. Retainer slide 38 is made of spring metal in a U-shape. Legs 64 and 68 are closer together at apex 72 of the U-shape than they are at grip end 76. Width 78 of the legs is less than width 80 of slot 90 which receives retainer slide 38. Width 84 of the legs at the grip end is greater than width 80 so that when retainer slide 38 is fully inserted into slot 80, shoulders 96 and 98 spring outward against wall 104 to prevent withdrawal of the retainer slide from the head. One or both legs may include a portion which extends laterally behind wall 104 when the shoulders spring outward against wall 104, to provide a lock that further prevents withdrawal of the retainer slide from the head.

Retainer slide 38, when fully inserted into head 24, may be removed by squeezing the legs together by applying finger or tweezer pressure on surfaces 110 and 112 of the legs. Support plates 132 and 132' below the retainer slide support the retainer slide below bars 28 and 30. Edges or sides 52 and 54 of apertures 56 and 58, and edges or sides 52' and 54' of apertures 56' and 58' guide element 60, and limit lateral movement shown by arrows 144.

The upper edges of the apertures, in cooperation with upper surface 150 (see FIG. 2) of retainer slide 38, and the irregular profile of element 60 limit rotational displacement in a direction around element 60. The rotational displacement is shown by arrow 154.

Figure 2:
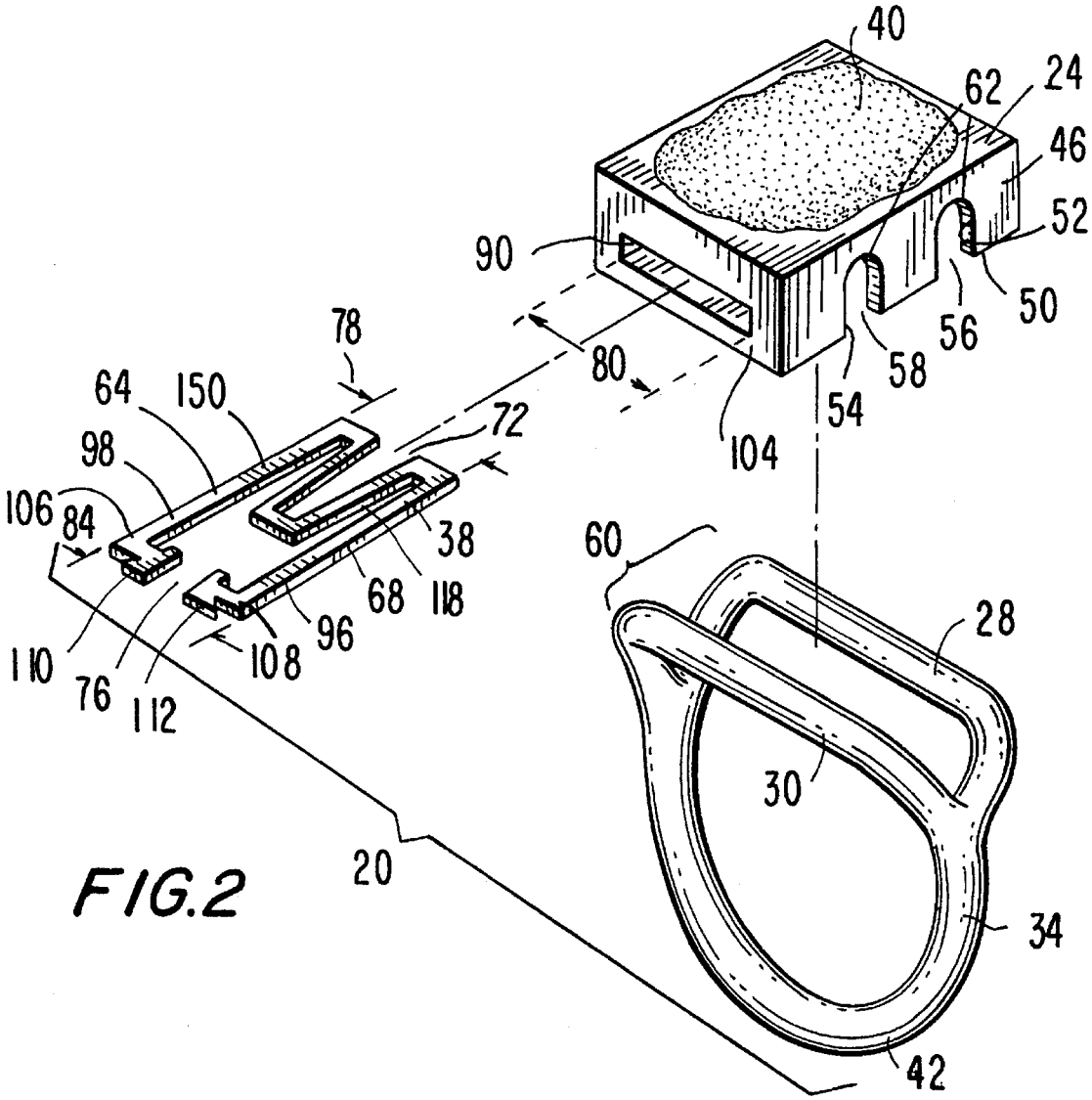
FIG. 2 is an exploded view of the jewelry system shown in FIG. 1.
Figure 3:
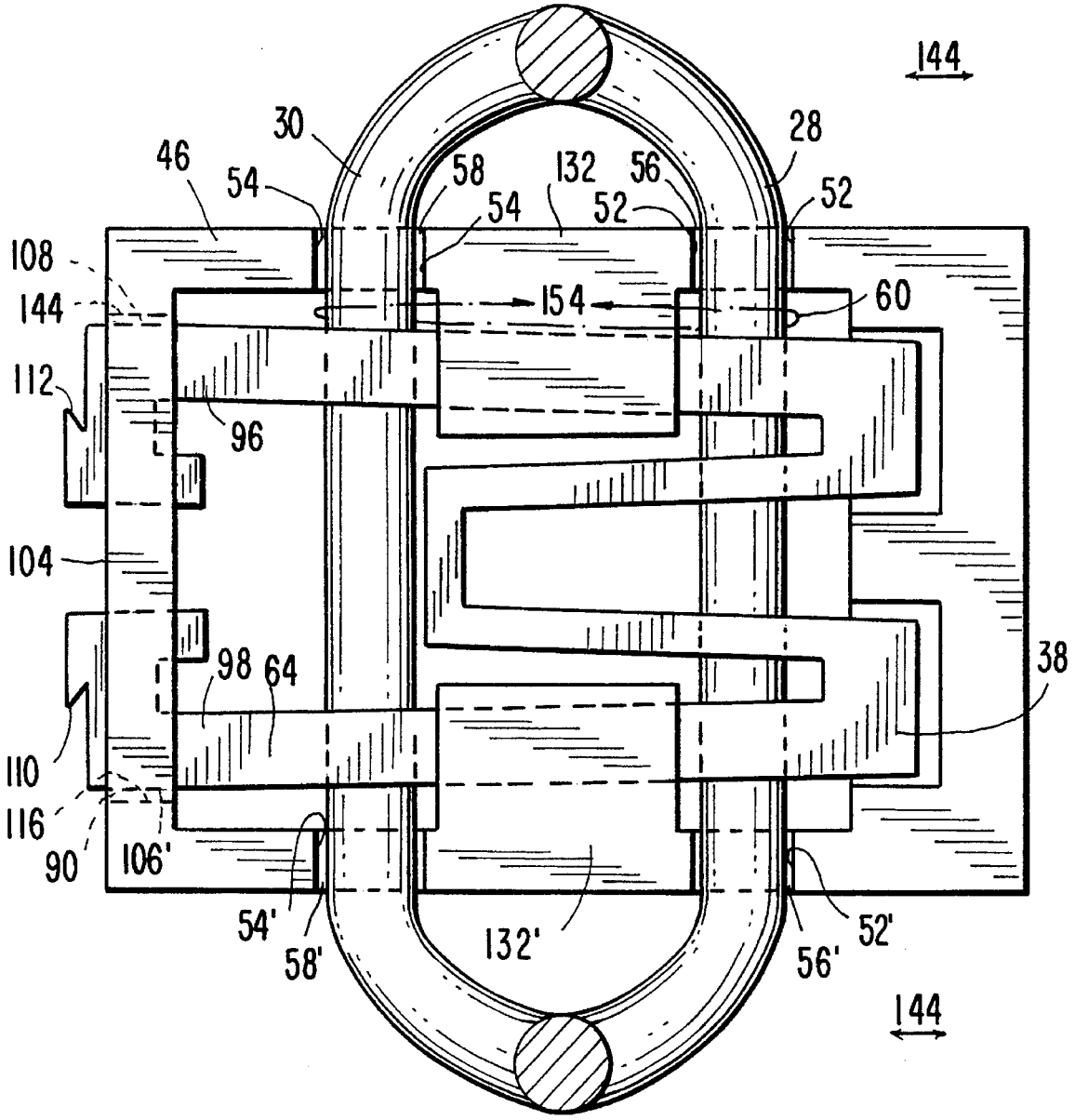
FIG. 3 is a bottom plan view of the system shown in FIG. 1.
Figure 4:
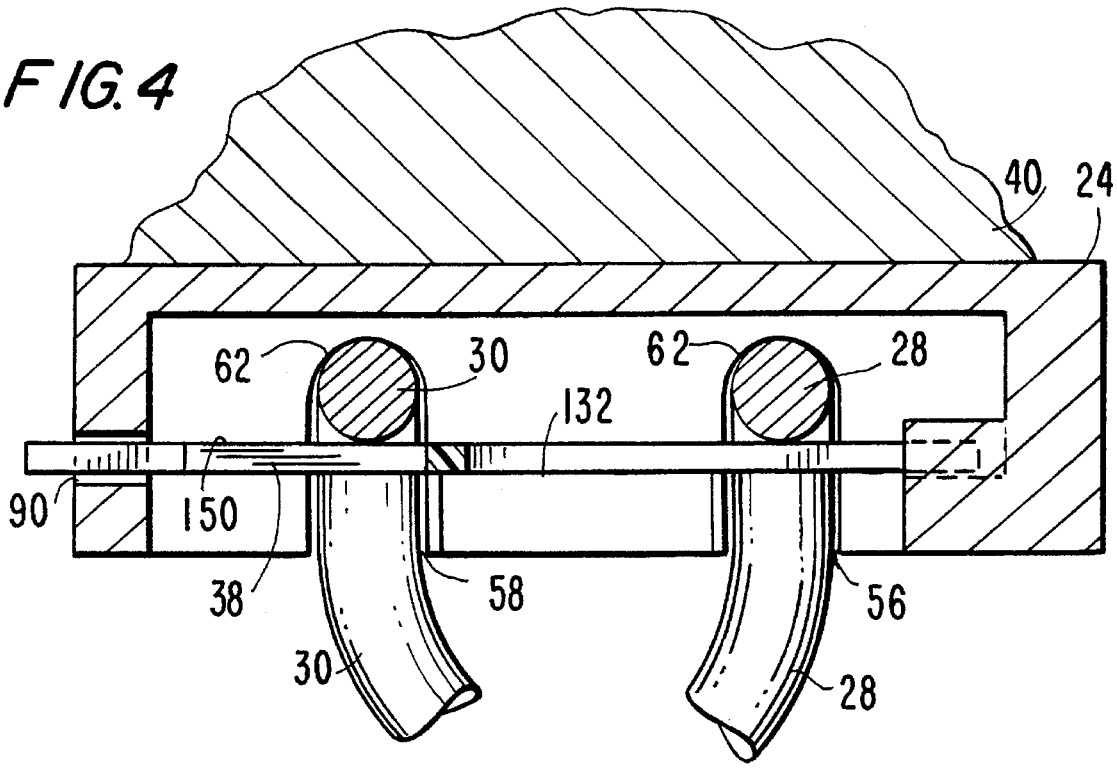
FIG. 4 is a side section view of the system shown in FIG. 1, viewed along 4—4.

Referring to FIGS. 2, 3, and 4, pressure surfaces 106 and 108 of retainer slide 38 are in engagement with edges 114 and 116 of slot 90 in wall 104 and resist withdrawal of the retainer slide from the head. Shoulders 96 and 98 are forced toward one another by edges 116 and 114 of wall 104, against the urging of internal spring portion 118 of retainer slide 38 to keep them apart. When legs 64 and 68 are squeezed together enough so that the distance between surfaces 106 and 108 is reduced to less than width 80 of slot 90, the retainer slide can be easily withdrawn from head 24.

Figure 5:
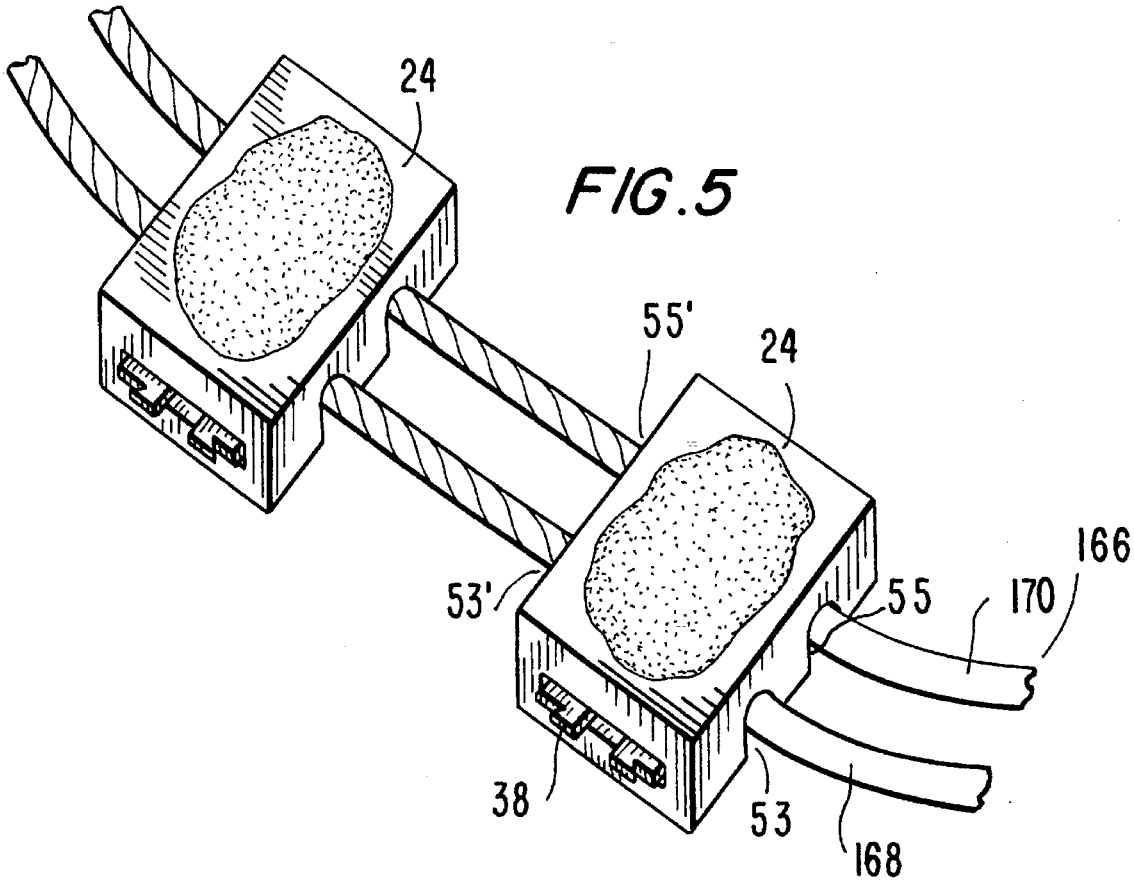
FIG. 5 is a perspective view of the jewelry system according to the present invention showing the same head of FIG. 1 mounted to a jewelry chain, such as in a bracelet or necklace.

FIG. 5 shows decorative head 24 on a bracelet or necklace 166 item of jewelry having two strands or chains 168 and 170. The strands are guided by openings 53–53' and 55–55' and retained by retainer 38 on head 24, in the same manner as the head 24 is joined to the bars 28 and 30 of ring 34.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. An item of jewelry comprising a body loop component and an interchangeable head component forming a jewelry system comprising:

said interchangeable head comprising a decorative portion, said interchangeable head having a top and a bottom, a first side wall between said top and said bottom attached to said head, a second side wall between said top and said bottom; opposite to said first side wall, and attached to said head, and a third side wall between said top and said bottom, said third side wall located between said first and second side walls, and attached to said head, said body loop component having transverse securement means, said first and second side walls being open to said bottom for receiving said transverse securement means through said first and second side walls, said third side wall comprising an opening for receiving retainer means movable into said head through said third wall transversely to said transverse securement means and below said transverse securement means when said transverse securement means is received in said first and second side walls, the transverse securement means being frictionally held in place by said retainer means bearing against said transverse securement means, said retainer means comprising flexible coplanar elements permitting the size of the retainer means to be small enough to pass through said opening and large enough to be held in place after said retainer means is inserted in said opening, wherein the same interchangeable head may be secured to any of several different body loop components of jewelry such as a ring, necklace, or bracelet.

2. The jewelry system described in claim 1, wherein said transverse securement means is taken from the class consisting of a jewelry shank, a chain for a bracelet, and a chain for a necklace.

3. The jewelry system described in claim 1, wherein said head comprises means for supporting said retainer means below said transverse securement means when said transverse securement means is in place and said retainer means is received through said third wall transversely to said transverse securement means, said retainer means being separate from said head and frictionally bearing on said transverse securement means.

4. The jewelry system described in claim 2, wherein said head comprises means for supporting said retainer means below said transverse securement means when said transverse securement means is received in said guide means and said retainer means is received through said third wall transversely to said transverse securement means, said retainer means being separate from said head and frictionally bearing on said transverse securement means.

5. The jewelry system described in claim 1, wherein said securement means comprises a bar member comprising two bars being close to one another and being parallel to each other wherein said bar means is received through said first wall.

6. The jewelry system described in claim 5, wherein said two bars are rigidly positioned with respect to one another.

7. The jewelry system described in claim 1, further comprising fourth side wall means depending from said head and being positioned opposite to said third side wall, wherein said retainer means extends between said third and fourth side walls of said head when said retainer means is fully received into said head.

8. The jewelry system described in claim 2, further comprising fourth side wall means depending from said head and being positioned opposite to said third side wall, wherein said retainer means extends between said third and fourth side walls of said head when said retainer means is fully received into said head.

9. The jewelry system described in claim 1, wherein said head, said first, second and third side walls are formed as a unitary element.

10. The jewelry system described in claim 2, wherein said head, said first, second and third side walls are formed as a unitary element.

11. The jewelry system described in claim 7, wherein said head, said first, second, third and fourth side walls comprise a unitary element.

12. The jewelry system described in claim 8, wherein said head, said first, second, third and fourth walls comprise a unitary element.

13. The jewelry system described in claim 1, wherein said retainer means comprises a first leg and a second leg, said first leg being disposed toward said first side wall, and said second leg being disposed toward said second side wall when said retainer means is fully received in said head, and said retainer means further comprising spring means for urging said first and second legs into pressing engagement with said head.

14. The jewelry system described in claim 2, wherein said retainer means comprises a first leg and a second leg, said first leg being disposed toward said first side wall, and said second leg being disposed toward said second side wall when said-retainer means is fully received in said head, and said retainer means further comprising spring means for urging said first and second legs into pressing engagement with said head.

15. The jewelry system described in claim 13, further comprising:

means on one of said legs for engaging said head for preventing withdrawal of said retainer means from said head unless said spring means is forcibly moved against the force of said spring means.

16. The jewelry system described in claim 14, further comprising:

means on one of said legs for engaging said head for preventing withdrawal of said retainer means from said head unless said spring means is forcibly moved against the force of said spring means.

17. The jewelry system described in claim 15, wherein said retainer means is generally flat, of spring material formed in a U-shape, and adapted for insertion in said head with the apex of the U leading said legs of said U and said legs being wider than said opening of said third side wall for receiving said retainer means.

18. The jewelry system described in claim 16, wherein said retainer means is generally flat, of spring material formed in a U-shape, and adapted for insertion in said head with the apex of the U leading said legs of said U and said legs being wider than said opening of said third side wall for receiving said retainer means.

* * * * *